US007484562B2

(12) United States Patent
Fink

(10) Patent No.: US 7,484,562 B2
(45) Date of Patent: Feb. 3, 2009

(54) METHOD AND APPARATUS FOR CONTROLLING A QUANTITY OF A SPECIFIC GAS IN A GROUP OF GASES PRODUCED FROM A GIVEN WELL BORE

(75) Inventor: Joseph M. Fink, Cedar Bluff, VA (US)

(73) Assignee: CNX Gas Company LLC, Pittsburgh, PA (US)

( * ) Notice: Subject to any disclaimer, the term of this patent is extended or adjusted under 35 U.S.C. 154(b) by 171 days.

(21) Appl. No.: 11/264,477

(22) Filed: Nov. 1, 2005

(65) Prior Publication Data

US 2007/0095541 A1 May 3, 2007

(51) Int. Cl.
*E21B 43/12* (2006.01)

(52) U.S. Cl. ..... 166/250.15; 166/369; 166/53

(58) Field of Classification Search ..... 166/250.15, 166/369, 370, 53
See application file for complete search history.

(56) References Cited

U.S. PATENT DOCUMENTS 3,418,841 A * 12/1968 Issenmann ..... 73/19.01
3,989,478 A * 11/1976 Jones ..... 62/621
4,150,721 A 4/1979 Norwood
4,521,221 A * 6/1985 Richter et al. ..... 48/127.3
4,696,680 A * 9/1987 Ghate et al. ..... 95/103
4,887,464 A * 12/1989 Tannenbaum et al. .... 73/152.04
6,236,894 B1 5/2001 Stoisits et al.
6,978,210 B1 * 12/2005 Suter et al. ..... 702/13
7,073,595 B2 * 7/2006 Zupanick et al. ..... 166/370
2004/0244989 A1 * 12/2004 Eken ..... 166/369
2005/0143937 A1 * 6/2005 Morrow et al. ..... 702/27
2006/0201671 A1 * 9/2006 Rogers et al. ..... 166/250.12
2006/0202122 A1 * 9/2006 Gunn et al. ..... 250/339.13

* cited by examiner

*Primary Examiner*—Jennifer H Gay
*Assistant Examiner*—Robert E Fuller
(74) *Attorney, Agent, or Firm*—Beck & Thomas, P.C.

(57) ABSTRACT

This invention relates to a method and apparatus for controlling a gas in a group of gases produced from a reservoir and specifically relates to controlling the amount of methane gas in a group of gases produced from a reservoir.

17 Claims, 6 Drawing Sheets

METHOD AND APPARATUS FOR CONTROLLING A QUANTITY OF A SPECIFIC GAS IN A GROUP OF GASES PRODUCED FROM A GIVEN WELL BORE

BACKGROUND OF THE INVENTION

1. Field of the Invention

The present invention generally relates to controlling a gas in a group of gases produced from a reservoir and specifically relates to controlling the amount of methane gas in a group of gases produced from a reservoir.

Subterranean formations often contain desirable materials that can be used for many applications. Therefore, there is need to remove the desirable materials from the subterranean formation. The subterranean formations often extend horizontally over many thousands of feet and are often very shallow in depth.

Coal is a desirable material contained in a subterranean formation. Methane is also contained in the subterranean formation. When the coal is mined methane gas is released. After the coal is mined, air is introduced into the methane gas.

Wells are drilled into the subterranean formation to obtain the methane gas for commercial production. There can be hundreds of wells spread out through a mining formation.

The methane gas produced from the wells is sold to commercial energy suppliers. Each well is connected to a central pipeline that leads to the particular commercial energy supplier. The commercial energy supplier often requires that the gas produced and transferred in the central pipeline meet a certain BTU level or have a certain amount of methane gas.

Because air is introduced into the methane gas during the mining operations, the wells produce a group of gases. Sometimes the group of gases produced by the well does not meet the desired amount needed by the commercial energy supplier.

Initially when a well bore produces the methane content is high. However, over time the amount of methane in the group of gases can decrease.

2. Description of Related Art

Currently, well bores are manually checked by a person to determine the amount of methane being produced. If the amount of methane being produced by a particular well is not adequate then the well bore is closed. After a return visit, the well is checked and, if it can produce again at the proper level, the well is reopened. If the well is still not properly producing it may be permanently closed off. Because of the many well bores that the person has to visit, they probably are only able to check the well a maximum of once every three days. When a person checks a well they typically have to shut in the well to test it.

There is no other known method for controlling the amount of a specific gas in a group of gases produced from a well bore.

The object of this invention is to provide of method and apparatus for controlling the amount of methane gas in a group of gases produced from a given well bore.

DETAILED DESCRIPTION

Examples and Explanatory Definitions

Figure 1:
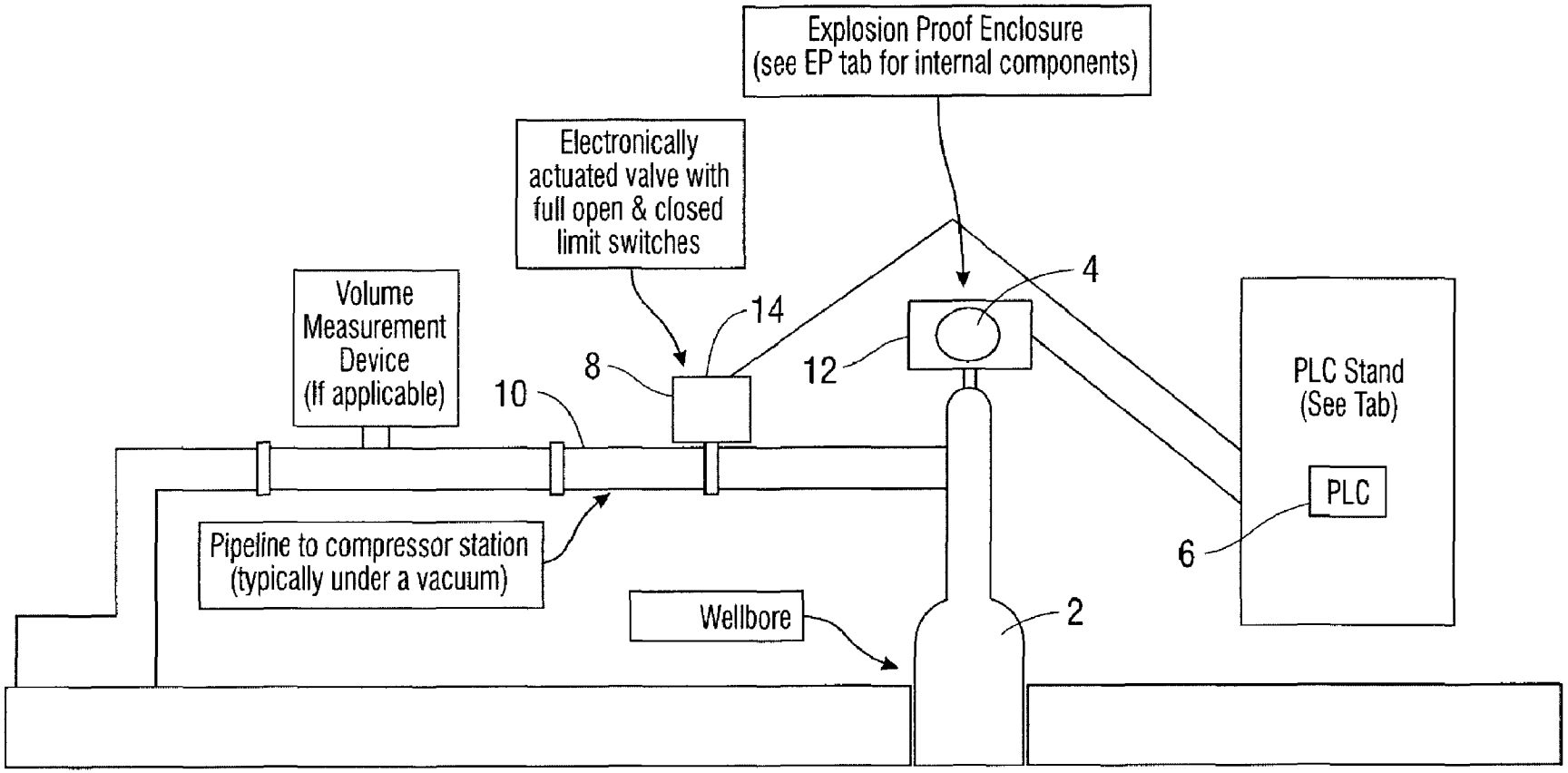
FIG. 1 is a sectional view of a well bore having a gas control apparatus for controlling the quantity of a specific gas using a gas analyzer.

"controlling a quantity of a specific gas"—via control device the quantity of a specific gas is monitored and based upon the value and a user defined set point the well bore's producing pressure is either increased or decreased to reach the desired quantity of gas. It can be the ability to change the amount of a certain gas in a group of gases produced from a well bore. In the case of controlling the quantity of methane examples:

if the set point is 85% and the actual value is 83% then the wellhead pressure is increased if the set point is 85% and the actual value is 87% then the wellhead pressure is decreased "specific gas"—choice component (examples: oxygen, nitrogen, carbon dioxide, methane) in a gas stream being produced from a well bore.

"group of gases"—the sum of all the components that account for the entire gas mixture.

"produced"—volume placed into a gathering system sales or usage, also includes gas that is vented to the atmosphere (gas that is removed from a well bore or gas reservoir for any reason).

"given well bore"—gas producing well drilled into a reservoir containing the stated group of gases.

"monitoring an amount of a component gas"—actively analyzing the quantity of a gas in a group of gases being produced from a well bore.

"component gas"—a gas out of a group of gases that can be used to calculate the quantity of the specific gas. Examples would include oxygen, nitrogen, carbon dioxide, and/or methane. For example if you want to control the quantity of methane gas (specific gas) the component gas could be methane. However, it could also be nitrogen, and then the amount of nitrogen could be used to calculate the amount of methane.

"control device"—PLC (Programmable Logic Controller) or an electronic device where control logic is programmed to perform a certain task and is connected to an automatic in-line valve.

"well bore exit"—the point where the gas is exiting the well bore to be produced.

"maintain a given quantity of the specific gas"—according to a setting within the control device (see controlling a quantity of a specific gas) the pressure at the exit is manipulated to achieve and maintain a quantity of a specific gas being produced. As the quantity of the specific gas changes, the control device reacts to change the pressure at the exit "setting the control device to the desire quantity of the specific gas"—user defined setting within the control device 0% to 100% per volume.

"controlling the pressure by the control device"—according to the logic within the control device, the pressure of the well bore is manipulated by the in-line valve. For example if the control device is set at 85% and the actual value is 83%, then the control device will adjust the in-line valve to close to increase the pressure.

"adjusting the pressure of the group of gases at the exit"—according to logic within the control device the pressure at the exit is adjusted by the in-line valve to maintain the desired quantity of a specific gas "produce the desired quantity of the specific gas"—he gases yielded from the well bore contain the desired amount of the component gas.

"maintaining by the control device the desired quantity of the specific gas"—using the control device to adjust the in-line valve so that desired amount of the specific gas is produced. For example if a person desired that the well bore produce 85% methane, the control device will keep adjusting the in-line valve so that gas produced from the well bore is 85%.

"adjusting the pressure in response to variations of the quantity of the specific gas in the group of gases"—controlling a quantity of a specific gas.

"continuously monitoring the amount of the component gas"—checking the amount of a gas in a group of gases at least once a day. It can include checking once every 1 second to 24 hours. Preferably it would be checked once every 15 minutes and 10 hours. Most preferably it would be checked once every 1 minute to 10 minutes.

"continuously maintaining by the control device the desired quantity of the specific gas"—according to logic programmed within the control device, the desired quantity of the specific gas is user defined (0-100), the control device analyzes the quantity of the specific gas in the stream and adjusts the valve position accordingly. This would include completing this process at least once every 24 hours. It can include completing the process once every 1 second to 24 hours. Preferably, the process would be completed once every 15 minutes to 10 hours. Most preferably, the process would be completed once every 1 minute to 10 minutes.

"continuously adjusting the pressure in response to variations of the quantity of specific gases" adjusting the in-line valve in response to the amount of the specific gas desired. The adjustment should take place at least once a day. It can include adjusting once every 1 second to 24 hours. Preferably it would be checked once every 15 minutes and 10 hours. Most preferable it would be checked once every 1 minute to 10 minutes.

"at the exit"—point where gas is leaving the well bore and entering the pipeline "continuously monitored"—Analyzing the quantity of a specific gas in a group of gases. It can include analyzing the gas real time to every 24 hours. Preferably the process would be completed once every 15 minutes to 10 hours. Most preferably the process would be completed once every 1 minute to 10 minutes.

"at a well bore that enters into a pipeline"—pressure adjusting valve is the isolation point between the well bore and the gathering pipeline.

"gas analyzer"—an electrical component that analyzes the quantity of a specific gas in a group of gases per volume.

1) Rel-Tek GasBoss 100/AP-TC December 2004
2) SMC (Sierra Monitor Corporation) Model 5100-28 October 2005

"explosion proof enclosure"—an enclosure that houses electrical or mechanical parts that my cause an ignition in a hazardous area. The enclosure is not made to prevent the explosion from occurring from within the box, it is meant to keep cool the escaping hot gases to the point that it cannot cause an explosion outside of the enclosure.

"explosion proof control valve and actuator combination"—an electric or pneumatic actuator and valve combination that is placed inside an explosion proof enclosure in terms of the electrical actuator or in terms of pneumatic actuation the explosion proof enclosure is generally not necessary as a gas or liquid provides the means for valve actuation (see above) so as not to cause an explosion in a hazardous location.

"energy content"—British Thermal Units (Btu), unit for measuring heat quantity in the customary system of English units of measurement, equal to the amount of heat required to raise the temperature of one pound of water at its maximum density [which occurs at a temperature of 39.1 degrees Fahrenheit (° F.) ] by 1° F. The Btu may also be defined for the temperature difference between 59° F. and 60° F. One Btu is approximately equivalent to the following: 251.9 calories; 778.26 foot-pounds; 1055 joules; 107.5 kilogram-meters; 0.0002928 kilowatt-hours. A pound (0.454 kilogram) of good coal when burned should yield 14,000 to 15,000 Btu; a pound of gasoline or other fuel oil, approximately 19,000 Btu.

"reservoir"—a place where the gas is being held in storage.

"gas stream"—produced gas

"programmable logic controller"—A programmable logic controller, PLC, or programmable controller is a small computer used for automation of real-world processes, such as control of machinery on factory assembly lines. The PLC usually uses a microprocessor. The program is usually created by a skilled technician at an industrial site, rather than a professional computer programmer. The program is stored in battery-backed memory. The main difference from other computers is the special input/output arrangements. These connect the PLC to a process' sensors and actuators. PLCs read limit switches, dual-level devices, temperature indicators and the positions of complex positioning systems. Some even use machine vision. On the actuator side, PLCs drive any kind of electric motor, pneumatic or hydraulic cylinders or diaphragms, magnetic relays or solenoids. The input/output arrangements may be built into a simple PLC, or the PLC may have external I/O modules attached to a proprietary computer network that plugs into the PLC.

| | |
|---|---|
| 1) Rel-tek PLC Express (Gold) DX8884 Serial #1003 | December 2004 |
| 2) Allen Bradley - Model # 1760-L12BWB | February 2005 |
| 3) Allen Bradley - Model # 1760-L18BWBEX | June 2005 |
| 4) Telemecanique - Model # TWDMDA20DTK | July 2005 |

"In-line valve"—valve and actuator combination controlled by the control device that adjust the pressure at the well bore to maintain a given quantity of a gas in the gas stream. This valve can be electrically or pneumatically driven.

1) Keystone—P/N: 2.0 920-723*K2HA2K2-BCDE-AYYYYY-YY April 2005 2" KEYSTONE FIGURE 920 TRIM 723, RESILIENT SEATED THIN DISC BUTTERFLY VALVE. LUG STYLE CAST IRON BODY, 316 STAINLESS STEEL DISC & STEM, BUNA SEAT MATERIAL. ASSEMBLED WITH A KEYSTONE EPI-6 ELECTRIC ACTUATOR. 120V AC POWER, WEATHERPROOF ALUMINUM NEMA 4/4X/7 HAZARDOUS AREA ENCLOSURE. OPEN & CLOSE TRAVEL LIMIT SWITCHES, 6 WATT ANTI-CONDENSATION HEATER. SIDE MOUNTED MANUAL HANDWHEEL.
2) P/N: 2.0 920-723*K2HH2K2-BCDE-CYYYYY-YY June 2005 2" KEYSTONE FIGURE 920 TRIM 723, RESILIENT SEATED THIN DISC BUTTERFLY VALVE. LUG STYLE CAST IRON BODY, 316 STAINLESS STEEL DISC & STEM, BUNA SEAT MATERIAL. ASSEMBLED WITH A KEYSTONE EPI-6 ELECTRIC ACTUATOR. 24V DC POWER, WEATHERPROOF ALUMINUM NEMA 4/4X/7 HAZARDOUS AREA ENCLOSURE. OPEN & CLOSE TRAVEL LIMIT SWITCHES, 5 WATT ANTI-CONDENSATION HEATER. SIDE MOUNTED MANUAL HANDWHEEL.

3) Valvcon—Model # VWX300S2S24D (24 Volt DC Actuator, 120 Volt AC Models are used as well) Model # 397-982 CI (ABZ Valve) May 2005

*Note larger Keystone valves and actuators, along with modulating actuators have been used with this system.

Permissible gas analyzer—an electrical component designed to be used in a hazardous environment (in this case, an environment where an explosive gas could be present) that analyzes the quantity of a specific gas in a group of gases per volume Permissible control valve and actuator combination—actuator and valve combination designed to be used in a hazardous environment (in this case, an environment where an explosive gas could be present). There is the potential for there to be a permissible valve actuator that is not explosion proof, meaning the actuator need not be rated explosion proof as it would, by design be unable to cause an ignition or an explosion.

DESCRIPTION

This invention is a method of producing/controlling/maintaining on a continual basis, a well connected to a formation or reservoir whether rock or compost or landfill of, out of a multi-component gaseous stream where in gaseous hydrocarbons are present and the quantity of which is dependent on the producing pressure of the well/reservoir whether that be under a positive or negative pressure depending on the nature of each individual well/reservoir. Gas is usually pulled out of the well under a vacuum.

FIG. 1 shows a well bore 2. A gas analyzer 4 is used to monitor an amount of a component gas in a given volume of the group of gases removed from the well bore. The component gas could be methane. It could also be nitrogen or another gas that could be used to calculate the amount of methane in the group of gases. The group of gases could be methane, nitrogen, oxygen, carbon dioxide, propane, and ethane. A control device 6 connected to an in-line valve 8 is provided to adjust pressure at a well bore exit 10. The control device is also connected to the gas analyzer 4. The control device 6 can be a programmable logic controller. The programmable logic controller can be programmed by a programmer to run the proper operations to perform the method.

The control device 6 is set to a desired quantity of a specific gas. For example the control device could be set so that the well bore 2 produces gas containing 85% methane. The control device 6 controls pressure of the group of gases by adjusting the in-line valve 8 so that the gas produced from the well is 85% methane. The control device 6 maintains the desired quantity of the specific gas by adjusting the pressure in response to variations of the quantity of the specific gas in the group of gases. For example if the gas analyzer 4 indicates a value of 83% then control device 6 adjusts the in-line valve 8 so the wellhead pressure is increased and 85% methane gas is produced. This process can be done on a continuous basis without shutting down the well.

The gas analyzer 4 can be a non permissible gas analyzer located within an explosion proof enclosure 12 and there can be an explosion proof control valve and actuator combination 14. Alternatively, the gas analyzer 4 could be a permissible gas analyzer and there could be a permissible control valve and actuator combination.

If the control device 6 is unable to maintain the desired quantity of the specific gas the flow of gases is restricted at exit 10 so that no gas is produced.

The control device 6 will then reestablish the flow of gases after a preset time period regardless of the quantity of the specific gas, so that a fresh sample of the producing gas coal seam can be tested periodically regardless of initial gas quality.

Figure 2:
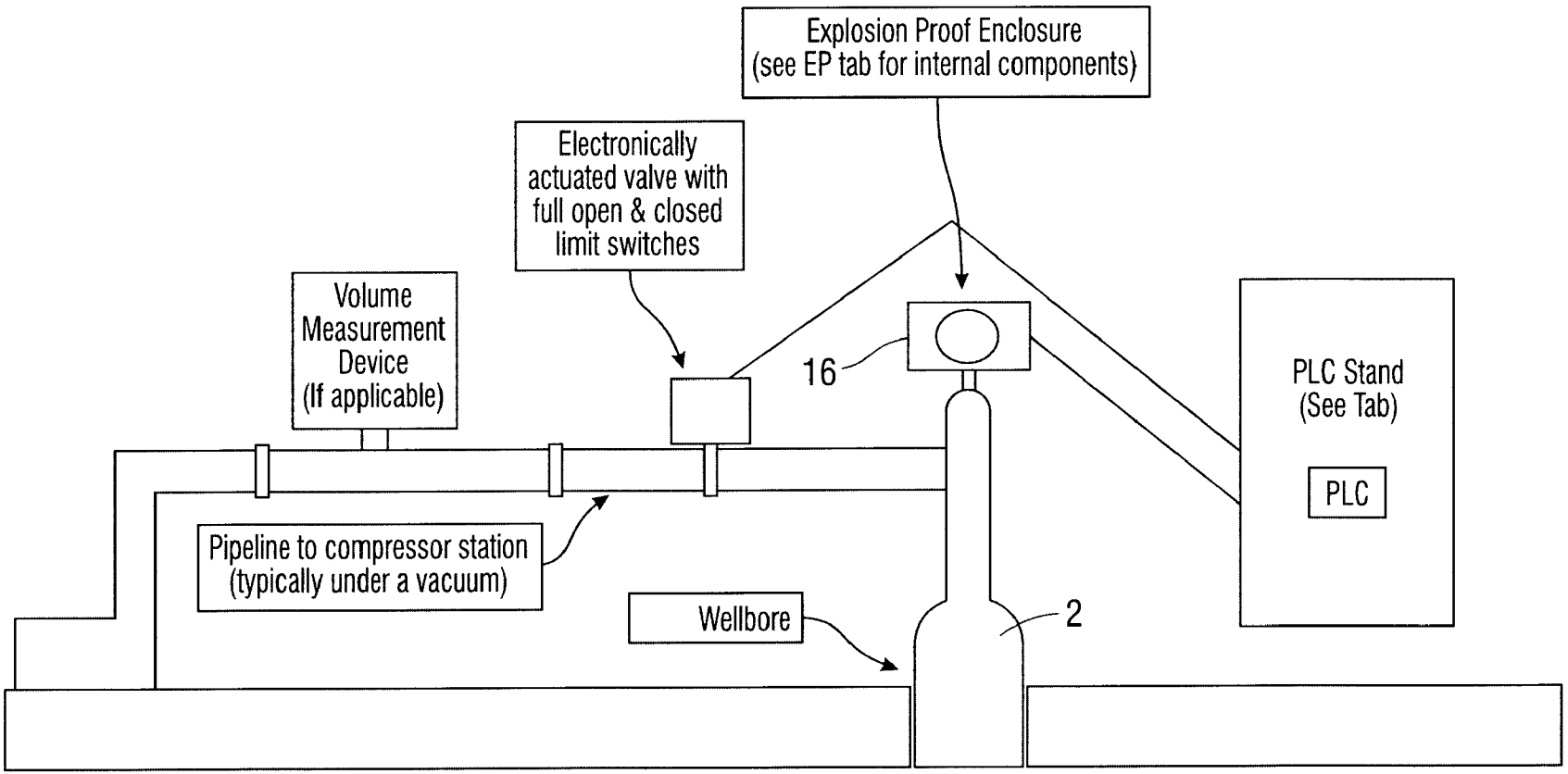
FIG. 2. is a sectional view of a well bore using an energy content analyzer.

FIG. 2 shows substantially the same method as shown in FIG. 1 except the gas analyzer 4 is replaced with an energy content analyzer.

If a gaseous mixture is nearly 100% methane, then more gas is being produced from the formation than is being captured. Therefore, there should be some amount of inert gases in the stream to insure maximizing the wells potential.

There are several phenomena that influence the quality of a given reservoir and inlaying well bore. This method of well control is designed to more closely control the influence of atmospheric contamination related to the state at which the reservoir is sealed from outside air (atmosphere) contamination.

Figure 3:
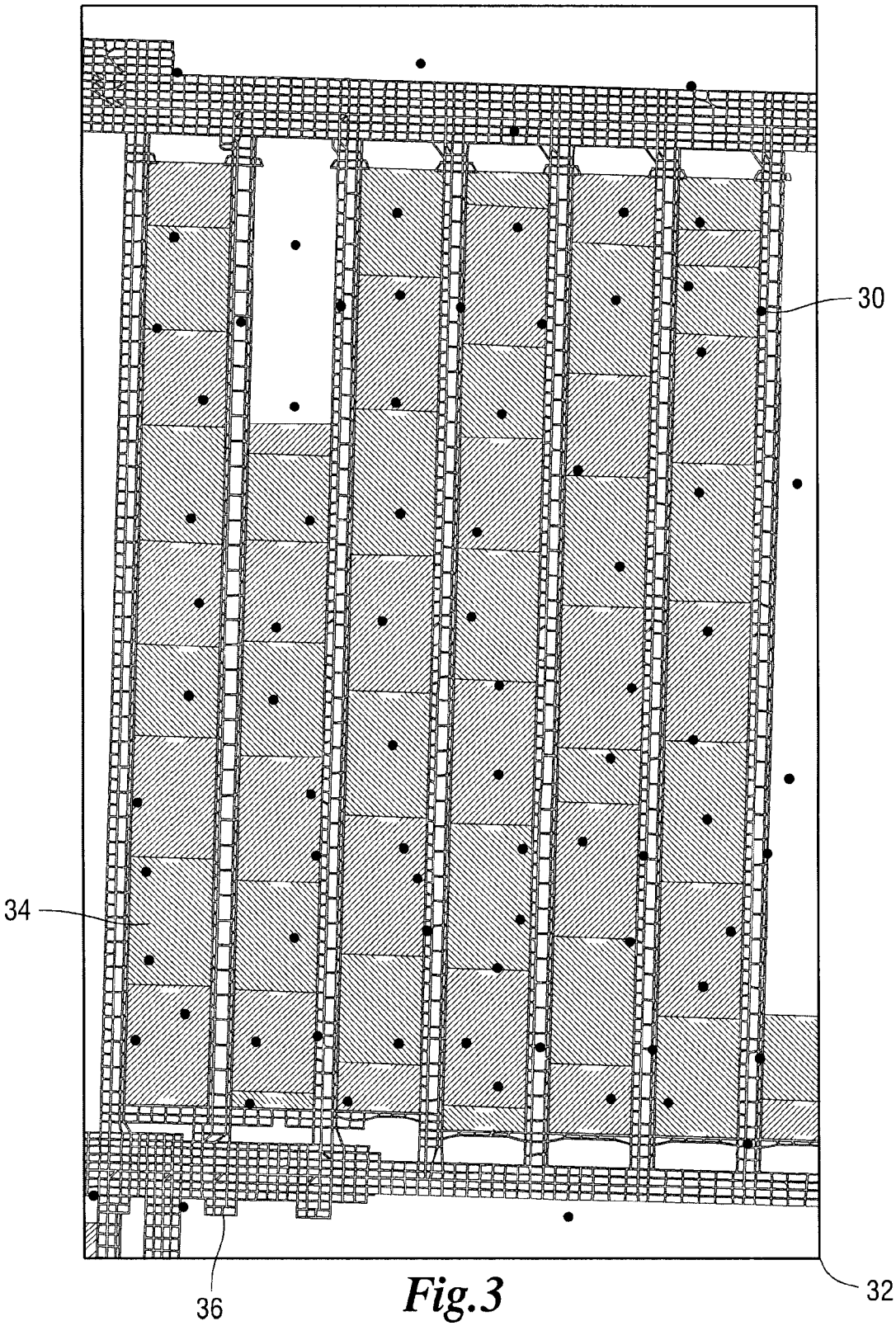
FIG. 3 is a map showing an underground coal mining area.

FIG. 3 is a map showing an underground coal mining area. Notice the location of the wells 30 within the mined area 32. The shaded area of the map shows where the mine has the coal seam removed 34. The series of boxes 36 between these areas are blocks of coal left for man and air passageways. By law, a very low (typically 2% methane or less) methane level must be maintained in these passageways during mining. To accomplish this, large fans are placed strategically on the surface that both push air into and out of the mine.

Figure 4:
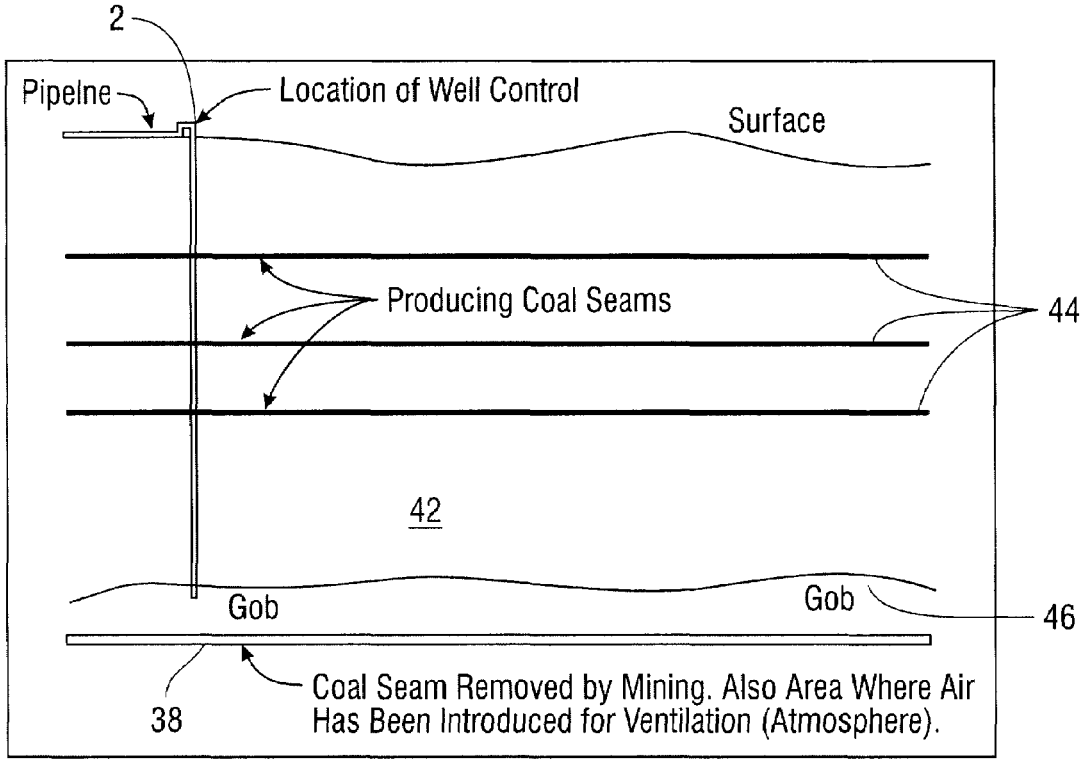
FIG. 4. illustrates a cross-sectional view of a substantially vertical well bore penetrating through and extending below coal seams.

FIG. 4 is a cross sectional view of both the well and the strata at and above the coal seam being mined 38. Notice that there are several seams of coal 44 above the seam of coal being mined 38.

Figure 5A:
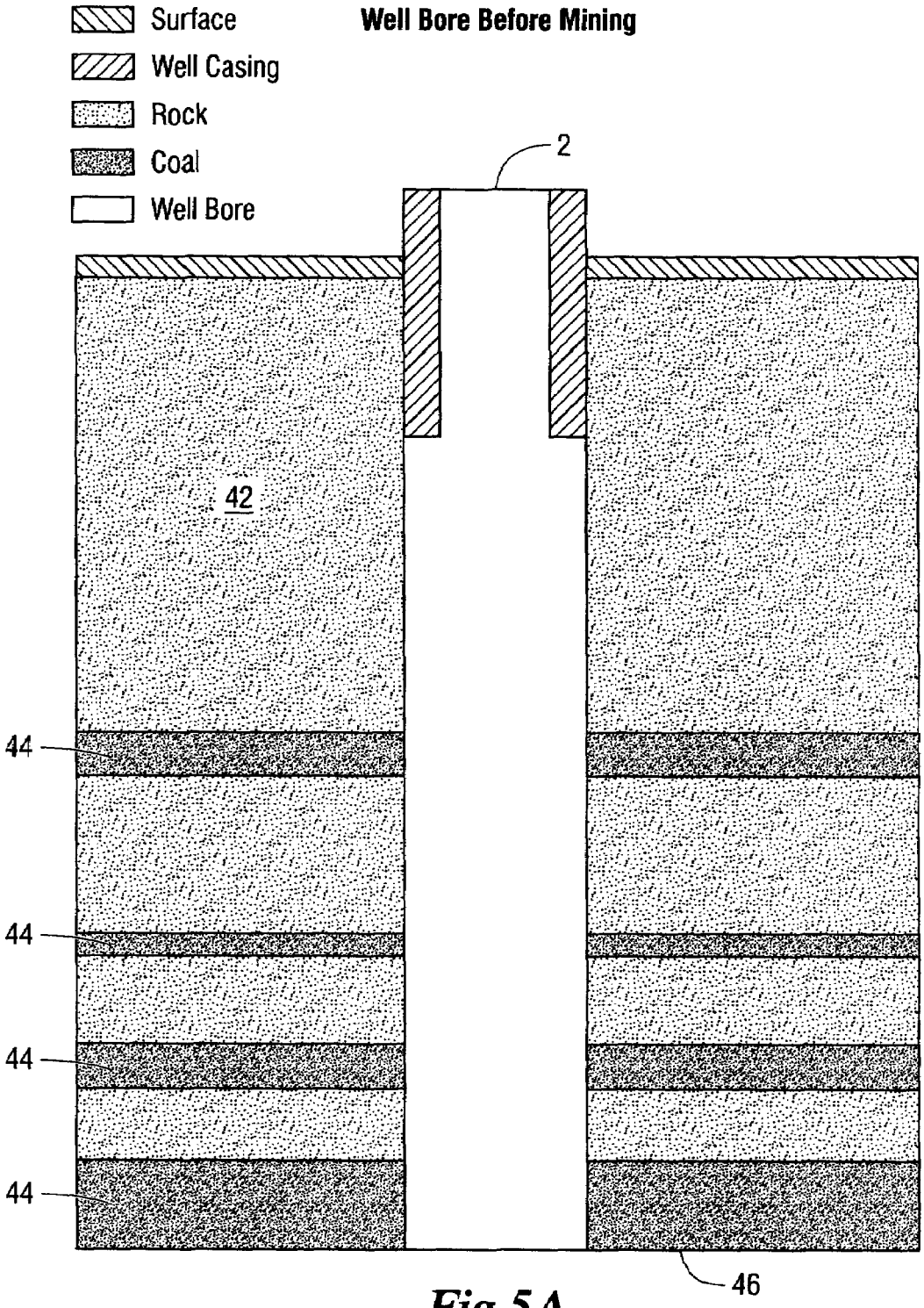
FIG. 5*a* illustrates a cross-sectional view of a substantially vertical well bore penetrating through and extending below coal seams without mining.
Figure 5B:
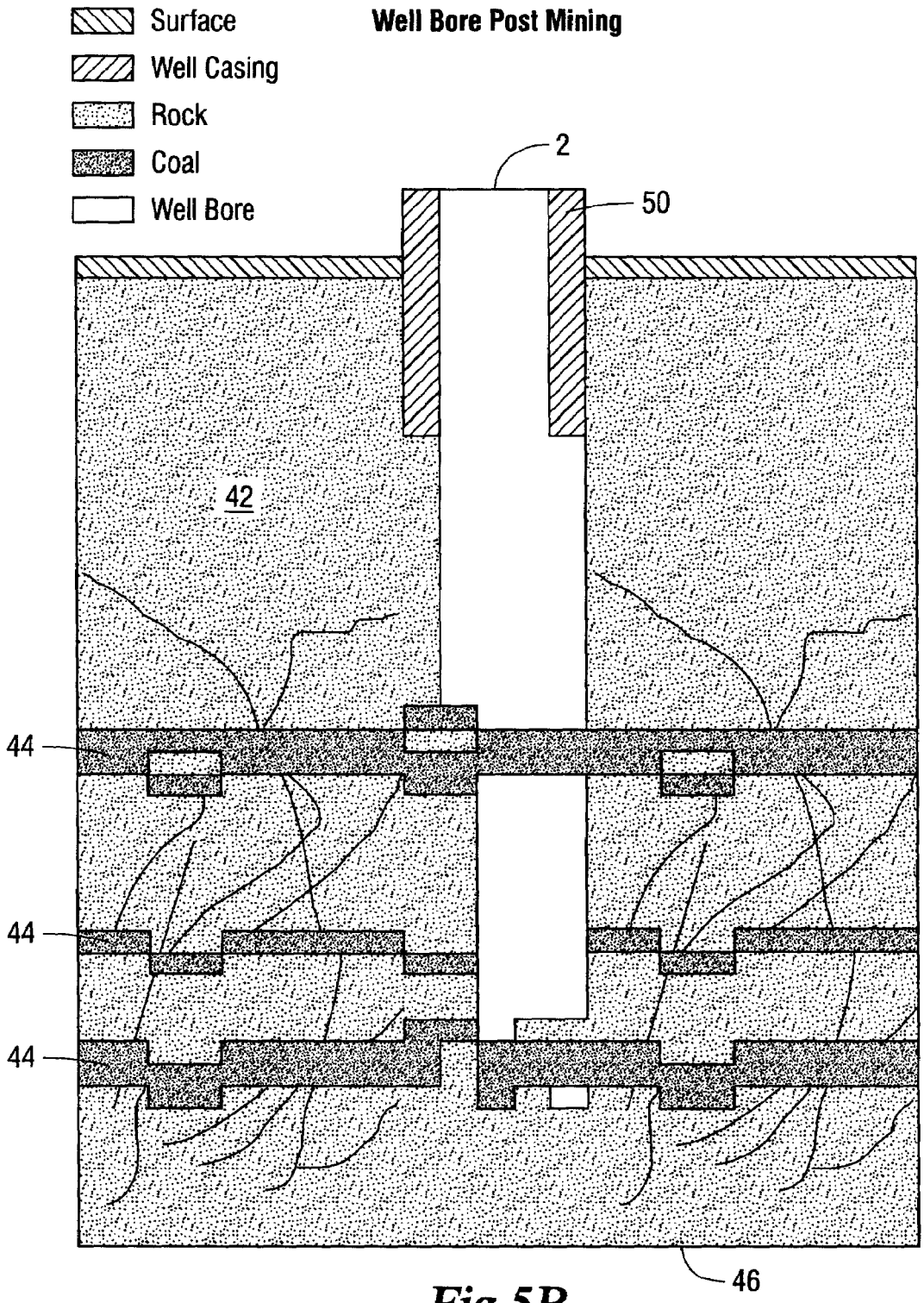
FIG. 5*b* illustrates a cross-sectional view of a substantially vertical well bore penetrating through and extending below coal seams with mining.

As shown in FIG. 5*b*, when a seam of coal 44 is removed, the rock strata 48 above the void fractures. This highly fractured area is called gob 46. The amount of fracturing is greatest just above the void. Approaching the surface, the fractures decrease in size and quantity and at surface level ground subsidence is rarely observed. It is this fracturing that offers a path for the gaseous hydrocarbons to be released into the open well bore 2. FIG. 5*a* shows an enlargement of the well bore pre mining and 5*b* shows post mining. Notice that the well bore is simply an opening that is only cased 50 a short distance, otherwise the well bore 2 is an open hole. By only casing 50 the well a short distance, gas can be produced from all of the coal seams 44 that the well intersects in spite of how the stratum is fractured. Also note that post mining ventilation air is still being circulated through the gob (mined area). Ideally a producer would capture only the gas being released from the upper seams of coal while leaving the mine atmosphere (which generally has very little methane content) in the mine. Because of changes in the well, stratum, and mine ventilation, this is impossible and ever changing. If less gas is captured than produced by the upper seams, the balance is pushed into the gob 46 and carried away by the mine's ventilation system (fans). If more gas is captured than the upper seams produce then the balance is mine atmosphere, which contaminates the upper seam gas with mine atmosphere. By balancing the capture of gas produced by the upper seams of coal and mine atmosphere in a quantity such as 85% methane and 15% inert, the capture all of the upper coal seam gases is maximized (assuming that the upper seams are near 100% methane in content).

The control device 6 controls the rate and producing pressure applied to the well/reservoir so that upper seam gas is wholly produced while reducing the amount of mine atmosphere that is pulled into the well bore 2. In order to maximize the production of such well/reservoir some balance of inert gas needs to be present in the total mixture to insure that all the methane is being recovered. Separation of the upper coal seam gas and mine atmosphere is a function of the amount being produced by the upper coal seams and the pressure needed to keep the mine atmosphere suspended at mine level. Pressure is being added to the well (+/−) so that the methane can be produced. However when the pressure is added to the well other gases mix with the methane and are pulled from the well along with the methane. All wells are different so the production rate can't be based solely on a single pressure. The percent of methane in the mixture must be determined and the pressure must be adjusted in response to the change of composition in the gas stream. This change in composition, as stated previously, can vary radically and frequently during the life of the well.

When the method described above is used continuously which is defined above the production of the gas is maximized.

Gas producers are contracted by a buyer to provide a gas stream with at least a BTU value suitable for some use. An Example is 970 BTU. 100% methane has a BTU value of about 1010 BTU. 970 BTU gas is typically nitrogen, oxygen, carbon dioxide none of which have a BTU value and therefore lowers the methane value of 1005 to 970.

There are several instances where the invention could be of benefit in the oil and gas industry. For example if gas was produced from multiple zones and had more than production string in the well bore within the well bore and these zones had different energy content associated with them, this device could be used to blend the gases from each zone in order to produce pipeline spec gas.

Various changes could be made in the above construction and method without departing from the scope of the invention as defined in the claims below. It is intended that all matter contained in the above description as shown in the accompanying drawings shall be interpreted as illustrative and not as a limitation.

I claim:

1. A method for controlling a quantity of a specific gas in a group of gases produced from a given well bore that has access to one or both of upper seam gas and mine atmosphere in order to produce the group of gases comprising:

a. monitoring an amount of a component gas in a given volume of the group of gases removed from the well bore;

b. providing a control device for adjusting pressure at a well bore exit to maintain a given quantity of the specific gas;

c. setting the control device to the desired quantity of the specific gas;

d. controlling the pressure by the control device by adjusting the pressure of the group of gases at the exit so that the capture of upper seam gas with mine atmosphere is balanced prior to exiting the well bore to produce the desired quantity of the specific gas;

e. maintaining by the control device the desired quantity of the specific gas by adjusting the pressure in response to variations of the quantity of the specific gas in the group of gases caused by changes in the balance between the upper seam gas and the mine atmosphere captured.

2. The method as recited in claim 1 including:

a. continuously monitoring the amount of the component gas; and b. continuously maintaining by the control device the desired quantity of the specific gas by continuously adjusting the pressure in response to variations of the quantity of the specific gas in the group of gases at the exit.

3. The method as recited in claim 2 wherein the component gas is continuously monitored by a permissible gas analyzer.

4. The method as recited in claim 2 wherein the component gas is continuously monitored by a non permissible gas analyzer located within an explosion proof enclosure.

5. The method as recited in claim 2 wherein the pressure at the exit is controlled by an explosion proof control valve and actuator combination.

6. The method as recited in claim 2 wherein the pressure at the exit is controlled by a permissible control valve and actuator combination.

7. The method as recited in claim 1 wherein the component gas is continuously monitored at a well bore that enters into a pipeline.

8. A method for controlling a quantity of a specific gas in a group of gases produced from a given well bore comprising:

a. monitoring an amount of a component gas in a given volume of the group of gases removed from the well bore;

b. providing a control device for adjusting pressure at a well bore exit to maintain a given quantity of the specific gas;

c. setting the control device to the desired quantity of the specific gas;

d. controlling the pressure by the control device by adjusting the pressure of the group of gases at the exit to produce the desired quantity of the specific gas;

e. maintaining by the control device the desired quantity of the specific gas by adjusting the pressure in response to variations of the quantity of the specific gas in the group of gases;

f. restricting a flow of gases at the exit when the control device is unable to maintain the desired quantity of a specific gas; and g. reestablishing the flow of gases after a set time period preset by the control device regardless of the quantity of the specific gas so that the well bore can be purged to the quantity of a specific gas in the group of gases after the purge.

9. A method for maintaining a desired energy content of a group of gases produced from a reservoir having one or both of an upper seam gas and mine atmosphere where energy content is a function of producing pressure to the gas comprising:

a. monitoring the energy content of the gas produced from the well bore;

b. providing a control device for adjusting pressure at the well bore exit prior to entering a pipeline;

c. setting the control device to the desired energy content of the gas;

d. controlling the pressure of gas introduced into the pipeline by the control device by adjusting the pressure of the gas introduced into the pipeline in order to balance the capture of upper seam gas with mine atmosphere prior to the gas exiting the well bore;

e. maintaining by the control device the desired energy content of the gas by adjusting the pressure in response to variations of the energy content of the gas caused by changes in the balance between the upper seam gas and the mine atmosphere captured.

10. The method as recited in claim 9 including:

a. continuously monitoring the energy content of the group of gases; and b. continuously maintaining by the control device the desired energy content gas by continuously adjusting the pressure in response to variations of the energy content of the group of gases.

11. The method as recited in claim 10 wherein the energy content is continuously monitored by a permissible energy content analyzer.

12. The method as recited in claim 10 wherein the energy content is continuously monitored by a non permissible energy content analyzer located in an explosion proof enclosure.

13. The method as recited in claim 9 wherein the energy content is continuously monitored at a well bore that enters into a pipeline.

14. The method as recited in claim 9 wherein the pressure at the exit is controlled by an explosion proof control valve and actuator combination.

15. The method as recited in claim 9 wherein the pressure at the exit is controlled by a permissible control valve and actuator.

16. A method for maintaining a desired energy content of a group of gases produced from a reservoir where energy content is a function of producing pressure to the gas comprising:

a. monitoring the energy content of the gas produced from the well bore;

b. providing a control device for adjusting pressure at the well bore exit prior to entering a pipeline;

c. setting the control device to the desired energy content of the gas;

d. controlling the pressure of gas introduced into the pipeline by the control device by adjusting the pressure of the gas introduced into the pipeline;

e. maintaining by the control device the desired energy content of the gas by adjusting the pressure in response to variations of the energy content of the gas;

f. restricting a flow of gases at the exit when the control device is unable to maintain the desired energy content; and g. reestablishing the flow of gases after a set time period preset by the control device regardless of the energy content so that the well bore can be purged to the desired energy content.

17. A gas control apparatus for controlling a quantity of a specific gas in a group of gases produced from a well bore that has access to upper seam gas and mine atmosphere comprising:

a. a programmable logic controller having an input and an output, wherein the programmable logic controller contains a program for controlling the amount of the specific gas based on the amount of the specific gas;

b. a gas analyzer connected to the programmable logic controller input, wherein the gas analyzer provides the programmable logic controller with the amount of the specific gas; and c. an in-line valve connected to the programmable logic controller output and located so that when it adjusts pressure the capture of upper seam gas with mine atmosphere is balanced prior to the specific gas exiting the well bore, wherein the programmable logic controller adjusts the in-line valve based on input the programmable logic controller receives from the gas analyzer.

* * * * *

UNITED STATES PATENT AND TRADEMARK OFFICE

CERTIFICATE OF CORRECTION

PATENT NO. : 7,484,562 B2
APPLICATION NO. : 11/264477
DATED : February 3, 2009
INVENTOR(S) : Joseph M. Fink It is certified that error appears in the above-identified patent and that said Letters Patent is hereby corrected as shown below:

Column 1, Line 55 cancel "provide of method" and insert --provide a method--

Column 2, Line 62 cancel "the desire quantity" and insert --the desired quantity--

Column 3, Line 8 cancel "specific gas"—he" and insert --specific gas"—the--

Column 3, Line 25 cancel "minutes and 10" and insert --minutes to 10--

Column 3, Line 43 cancel "minutes and 10" and insert --minutes to 10--

Column 5, Line 14 cancel "permissible gas analyzer—" and insert --"permissible gas analyzer"— --

Column 5, Line 19 cancel "permissible control valve and actuator combination—" and insert --"permissible control valve and actuator combination"— --

Column 7, Line 29 cancel "1005 to 970" and insert --1010 to 970--

Signed and Sealed this

Twelfth Day of May, 2009

JOHN DOLL
*Acting Director of the United States Patent and Trademark Office*